US008794309B2

(12) United States Patent
O'Malley

(10) Patent No.: US 8,794,309 B2
(45) Date of Patent: Aug. 5, 2014

(54) FRANGIBLE SLIP FOR DOWNHOLE TOOLS

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 521 days.

(21) Appl. No.: 13/184,725

(22) Filed: Jul. 18, 2011

(65) Prior Publication Data

US 2013/0020071 A1 Jan. 24, 2013

(51) Int. Cl.
*E21B 33/129* (2006.01)
*E21B 33/126* (2006.01)

(52) U.S. Cl.
CPC ..... *E21B 33/129* (2013.01); *E21B 33/1265* (2013.01)
USPC ..... 166/118; 166/134

(58) Field of Classification Search
CPC ..... E21B 19/10; E21B 33/1265; E21B 33/129–33/1293; E21B 33/1295–33/12955
USPC ..... 166/118, 120, 134; 175/423
See application file for complete search history.

(56) References Cited

U.S. PATENT DOCUMENTS

| | | | | |
|---|---|---|---|---|
| 1,836,680 | A * | 12/1931 | Nixon | 175/423 |
| 1,923,283 | A * | 8/1933 | Stokes | 175/423 |
| 2,194,331 | A * | 3/1940 | Strom | 166/63 |
| 6,976,534 | B2 | 12/2005 | Sutton et al. | |
| 2009/0038790 | A1 * | 2/2009 | Barlow | 166/89.2 |
| 2009/0242214 | A1 * | 10/2009 | Foster et al. | 166/387 |

OTHER PUBLICATIONS

Product Report, ZXP Compression Set Liner Packer, Sep. 2001, Baker Hughes Incorporated, Houston, Texas, USA.
Gordon Mackenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

* cited by examiner

*Primary Examiner* — Giovanna Wright
(74) *Attorney, Agent, or Firm* — Parsons Behle & Latimer

(57) ABSTRACT

Slip members for use with downhole tools comprise a body formed of a first or body material and one or more hard material elements formed of a second or element material. The element material is harder than the body material. The hard material element is disposed through the body and in communication with a first surface and a second surface of the body, the second surface being disposed opposing the first surface. During manufacturing of the slip members, the hard material element may extend outwardly from one or both of the first and second surfaces. After manufacturing, the hard material element can be shaped to provide a gripping member.

16 Claims, 4 Drawing Sheets

FRANGIBLE SLIP FOR DOWNHOLE TOOLS

BACKGROUND

1. Field of Invention

The invention is directed to slip members for securing downhole tools such as bridge plugs and packers within a wellbore and, in particular, to slip members comprising one or more hard material elements disposed through a body material that is softer and, thus, easier to mill as compared to the hard material element(s).

2. Description of Art

During drilling and production of oil and gas wells, it is sometimes desirable to isolate zones within the wellbore such as by disposing downhole tools within the wellbore to seal-off a portion of the wellbore. Thus, downhole tools such as bridge plugs, packers, and the like are disposed within the wellbore. To secure the downhole tools within the wellbore, the downhole tool can comprise one or more slip members. The slip members include a gripping surface that is forced into the inner wall of the wellbore. For example, the slip members may include wickers or other gripping members that are forced into the inner wall of a casing by sliding the slip member along a cone or ramped surface. After setting of the downhole tool, additional downhole operations can be performed.

SUMMARY OF INVENTION

Broadly, slip members for use in connection with a downhole tool are disclosed. In one specific embodiment, the slip member comprises one or more hard material elements comprising a first material disposed through the slip member, the remainder of the slip member being formed form a second material. The second material comprises a material that is softer as compared to the first material. The hard material elements can be aligned through the slip member either at an angle that is perpendicular to a vertical axis of the slip member, or at an angle within the range from 0 degrees to 180 degrees relative to the vertical axis. In addition, the hard material elements can be hollow and can have numerous different cross-sections, e.g., circular or polygonal. Further, the hard material elements can be disposed in dense packs, or spread out from each other. In one particular embodiment, the hard material elements extend outward from both a first surface of the slip member and a second surface of the slip member, the second surface being disposed opposite the first surface, during construction so that the slip member can be manufactured with either the first surface comprising the gripping surface or the second surface comprising the gripping surface.

Figure 1A:
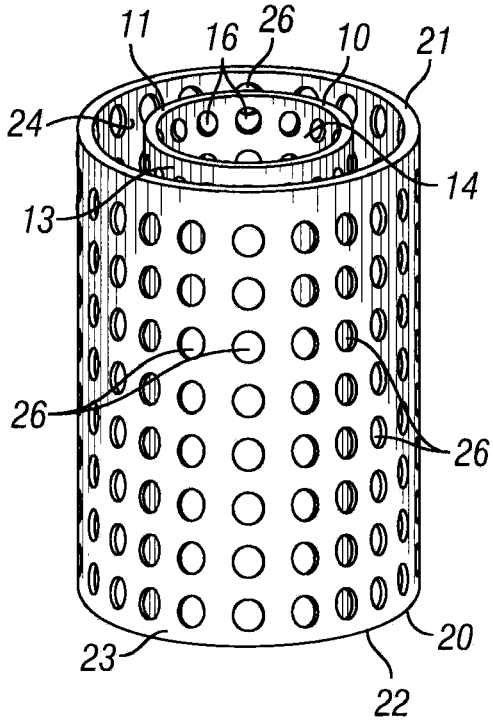
FIG. 1A is a perspective view of one particular embodiment of inner and outer molds for manufacturing one specific embodiment of a slip member.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to the Figures, in the manufacturing of various slip members, inner mold 10 is disposed within outer mold 20. Preferably, inner mold 10 is disposed concentric with outer mold 20. Inner mold 10 comprises upper end 11, lower end 12, outer wall surface 13, and inner wall surface 14. Apertures 16 are disposed between and in fluid communication with outer wall surface 13 and inner wall surface 14. As shown in the FIG. 1A, apertures 16 are circular shaped. However, it is to be understood that apertures 16 can comprise any shape desired or necessary for receiving hard material elements 30 for preparing the slip members.

Outer mold 20 comprises upper end 21, lower end 22, outer wall surface 23, and inner wall surface 24. Apertures 26 are disposed between and in fluid communication with outer wall surface 23 and inner wall surface 24. Apertures 26 are circular shaped, however, as discussed above with respect to apertures 16, apertures 26 can comprise any shape desired or necessary for receiving hard material elements 30 for preparing the slip members.

Apertures 16 are aligned with apertures 26 so that hard material elements 30 (shown for example in FIG. 2) can be inserted through both apertures 16 and apertures 26. Although apertures 16 and 26 are shown in complete alignment with each other in FIGS. 1A, 1B, and 2, it is to be understood that apertures 16, 26 are not required to be in complete alignment. In addition, although apertures 16 and 26 are shown as having the same dimensions, e.g., circumferences and diameters, in FIGS. 1A, 1B, and 2, it is to be understood that apertures 16, 26 are not required to have identical dimensions.

Figure 1B:
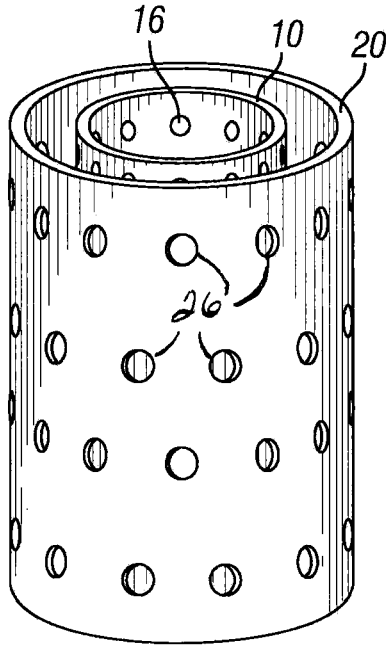
FIG. 1B is a perspective view of another particular embodiment of inner and outer molds for manufacturing another specific embodiment of a slip member.

In comparison to FIG. 1A, apertures 16, 26 shown in FIG. 1B are more spread out than apertures 16, 26 in FIG. 1A. Thus, slip members formed using inner mold 10 and outer mold 20 shown in FIG. 1B will have less hard material elements 30 per square area. In other words, the density of hard material elements 30 in the slip member formed using inner and outer molds 10, 20 shown in FIG. 1B is less than the density of hard material elements 30 in the slip member formed using inner and outer molds 10, 20 shown in FIG. 1A.

Figure 2:
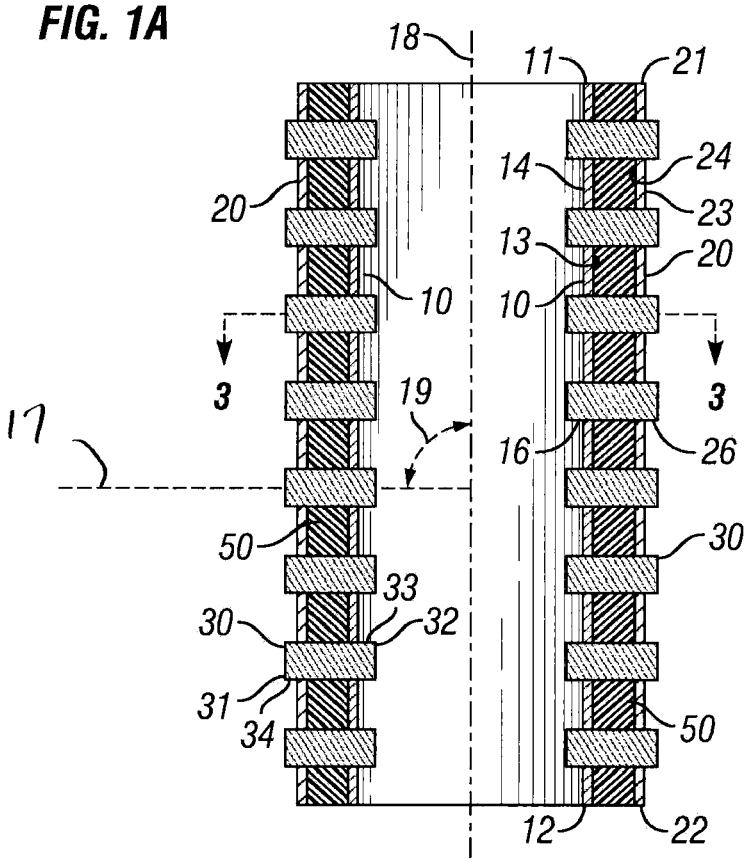
FIG. 2 is a cross-sectional view of the inner and outer molds shown in FIG. 1A showing the body material and hard material elements disposed within the inner and outer molds for the manufacture of one specific embodiment of a slip member.
Figure 3:
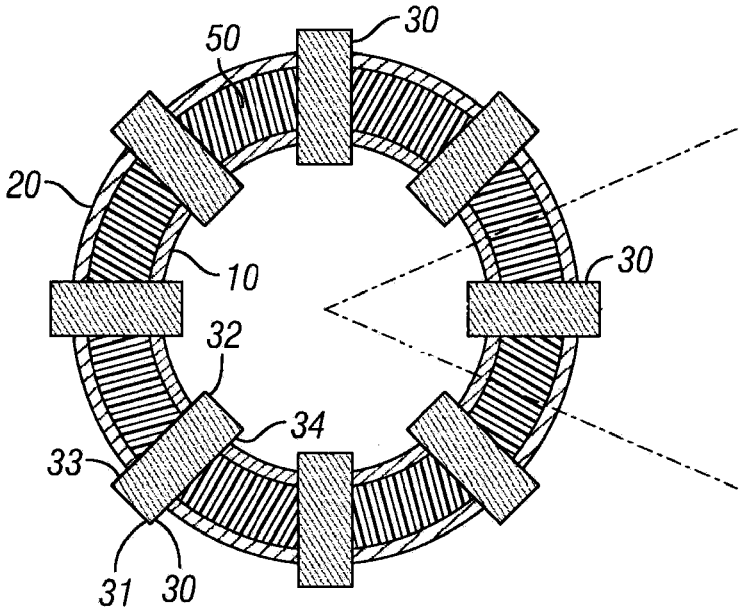
FIG. 3 is a cross-sectional view of the inner mold, the outer mold, the slip member body, and the hard material elements shown in FIG. 2 taken along line 3-3.

After disposing inner mold 10 within outer mold 20, hard material elements 30 are disposed through apertures 16, 26. Hard material elements 30 comprise first end 31 and second end 32, and first outer wall surface 33 and second outer wall surface 34 when shown in cross-section such as in FIGS. 2, 3, 5, 6. As shown in FIGS. 2-3, hard material elements 30 are solid. Hard material elements 30, however, are not required to be solid. Instead, as shown in FIGS. 5, 6, 7A, 7B, and 8, hard material elements 30 can include bore 36, thereby reducing the weight of the hard material element 30 and, thus, the weight of the slip member formed by such hard material elements 30.

Hard material elements 30 are formed from a metal, carbide, or ceramic material, sometimes referred to herein as the "element material." The element material is harder compared to the material forming body 50 of the slip member, sometimes referred to herein in as the "body material." The body material can comprise a castable material such as a resin or composite material. Examples of such resins or composite materials include epoxy resin polymers.

Hard material elements 30 can be disposed through apertures 16, 26 so that at least one end of hard material element 30 extends outward from either outer wall surface 23 of outer mold 20 or inner wall surface 14 of inner mold. As shown in FIG. 2, first and second ends 31, 32 of hard material element 30 extend outward from outer wall surface 23 and inner wall surface 14, respectively. Extension of hard material elements 30 outward from outer wall surface 23 and/or inner wall surface 14 permits formation of a gripping member using the extended portion of hard material element 30. The gripping member facilitates engagement of the slip member to a surface such as the inner wall of a casing disposed in a well. Extension of first end 31 and second end 32 outwardly from outer wall surface 23 and inner wall surface 14, respectively, permits construction of a slip member that can be used on a downhole tool with either an inner wall of the slip member comprising the gripping member or an outer wall surface of the slip comprising the gripping member.

Referring to FIGS. 2-3, hard material elements 30 are disposed through apertures 16, 26 such that axis 17 of each hard material element 30 is disposed an angle 19 to axis 18 of inner and outer molds 10, 20. As shown in FIG. 2, angle 19 is 90 degrees so that each hard material element 30 is disposed perpendicular to axis 19. As discussed in greater detail below, angle 19 is not required to be 90 degrees.

After disposing hard material elements 30 through apertures 16, 26, a body material, such as an epoxy resin polymer, is pored into the space between inner and outer molds 10, 20, thereby forming body 50 by capturing each hard material element 30 within body 50. Thus, the body material facilitates formation of body 50 of the slip member.

Figure 4A:
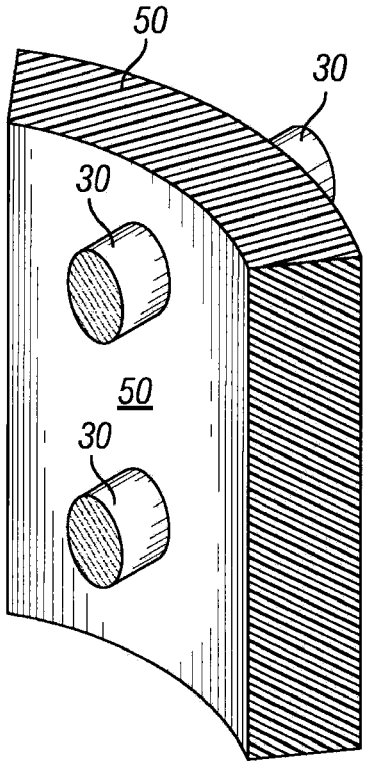
FIG. 4A is a partial perspective view of a slip member after removal of the inner and outer molds and cutting along the dotted lines shown in FIG. 3.

After the body material has set, inner and outer molds 10, 20 are removed to provide a cylindrically-shaped tubular body 50 having one or more hard material elements 30 extended through the body material. This tubular body can be cut into an initial slip-shaped member such as one or more wedges, such as along the dotted lines in FIG. 3, to provide the wedge partially shown in FIG. 4A. Thereafter, the initial slip-shaped member, e.g., a wedge, can be shaped using grinders or other tools to provide a slip member such as shown in FIG. 4B.

Figure 4B:
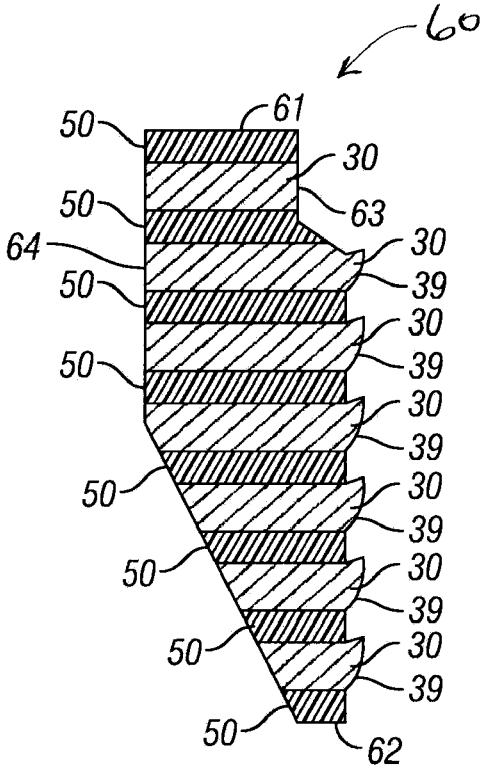
FIG. 4B is a cross-sectional view of one specific embodiment of a slip member.

As illustrated in FIG. 4B, one particular slip member 60 comprises upper end 61, lower end 62, first surface 63, and second surface 64. As shown in FIG. 4B, first surface 63 comprises a plurality of gripping members 39 shaped at one end of each of hard material elements 30 and, therefore, first surface 63 comprises a gripping surface. Due to the location of hard material elements 30 within body 50, a cross-sectional view, such as shown in FIG. 4B, shows alternating layers of body 50 and hard material elements 30.

After shaping the wedge, slip member 60 can be disposed on a downhole tool to facilitate securing the downhole tool within a well, such as within a cased wellbore.

Figure 5:
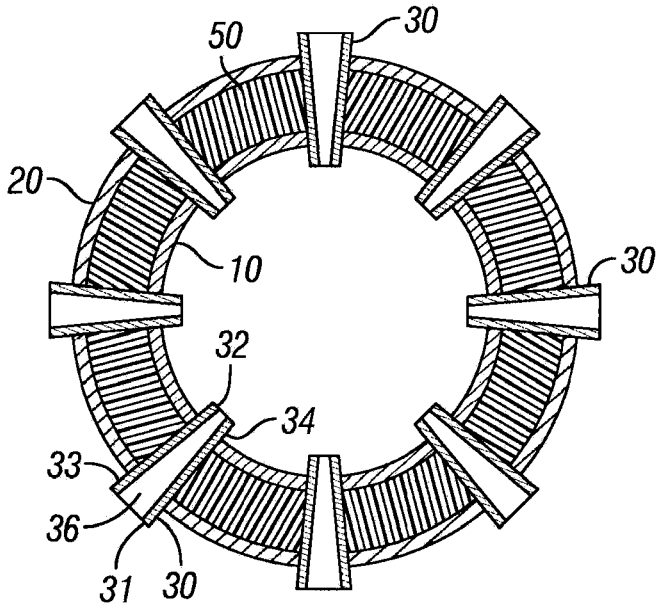
FIG. 5 is a horizontal cross-sectional view of the inner mold, the outer mold, the slip member body, and the hard material elements during manufacturing of another specific embodiment of a slip member.

Referring now to FIG. 5, in another embodiment, hard material element 30 comprises first and second outer wall surfaces 33, 34 that are tapered from first end 31 to second end 32. In addition, hard material element 30 comprises bore 36 which reduces the weight of each hard material element 30 and facilitates breaking up hard material element 30 during milling operations to remove the slip member from the well. Other than this change in the shape and design of hard material element 30, the slip members can be manufactured in a similar manner as described above.

Figure 6:
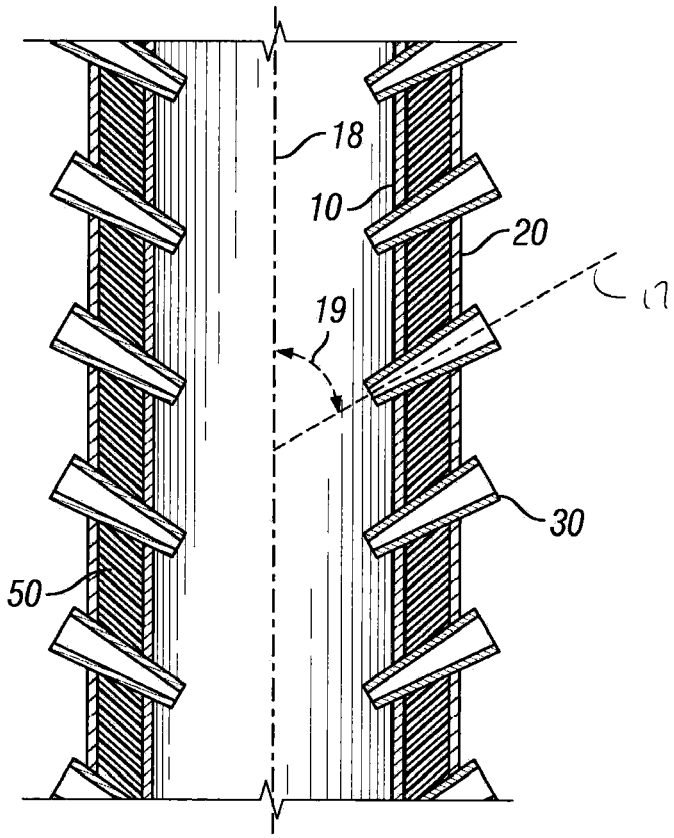
FIG. 6 is a vertical cross-sectional view of the inner mold, outer mold, the slip member body, and the hard material elements during manufacturing of an additional specific embodiment of a slip member.

As illustrated in FIG. 6, each hard material element 30 in this embodiment is disposed through apertures 16, 26 at angle 19 where angle 19 is not equal to 90 degrees. Instead, angle 19 is in the range from 0 degrees to 90 degrees. In one particular embodiment angle 19 is in the range from 10 to 75 degrees. Other than this change in the shape and design of hard material element 30, the slip members can be manufactured in a similar manner as described above.

Figure 7A:
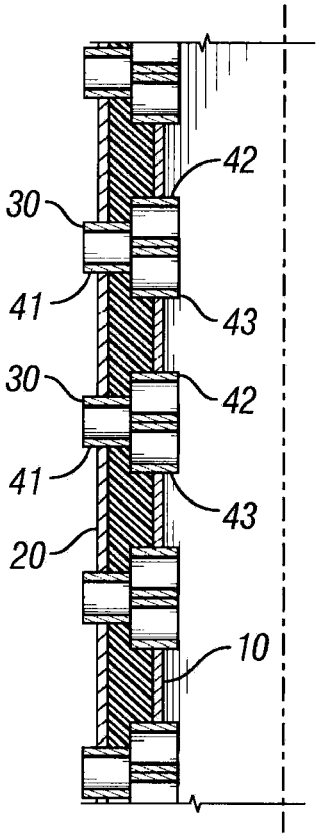
FIG. 7A is a partial vertical cross-sectional view of the inner mold, the outer mold, the slip member body, and the hard material elements during manufacturing of still another specific embodiment of a slip member.

Referring now to FIG. 7A, in another embodiment, hard material element 30 comprises first portion 41, second portion 42, and third portion 43 with first portion 41 being disposed such that it is in contact with both second and third portions 42, 43. This "stacking" arrangement provides greater strength to hard material element 30, yet still facilitate easy milling operations to remove the slip member from the well. As shown in FIG. 7A, second and third portions 42, 43 are disposed through inner mold 10 and first portion 41 is disposed through outer mold 20. It is to be understood, however, that first portion 41 can be disposed through inner mold 10 and second and third portions 42, 43 can be disposed through outer mold 20. Other than this change in the shape and design of hard material element 30, the slip members can be manufactured in a similar manner as described above.

Figure 7B:
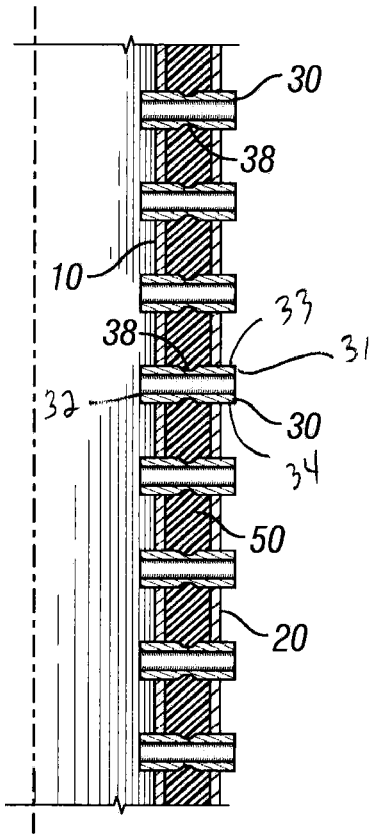
FIG. 7B is a partial vertical cross-sectional view of the inner mold, the outer mold, the slip member body, and the hard material elements during manufacturing of yet another specific embodiment of a slip member.

FIG. 7B shows an additional embodiment in which outer wall surfaces 33, 34 of hard material element 30 comprise recess 38 disposed between first and second ends 31, 32. Recess 38 is preferably disposed approximately half-way between first and second ends 31, 32. Recess 38 facilitates breaking up hard material element 30 during milling operations to remove the slip member from the well. Other than this change in the shape and design of hard material element 30, the slip members can be manufactured in a similar manner as described above.

Figure 8:
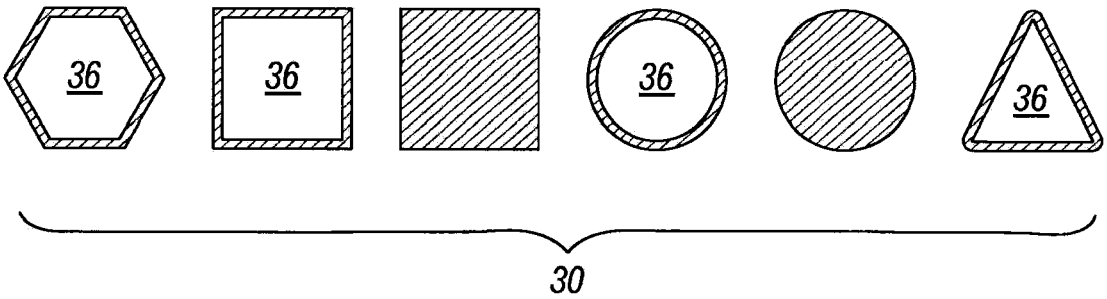
FIG. 8 is a cross-sectional view of six hard material elements each having a different cross-section.

Referring now to FIG. 8, hard material element 30 is shown as having several different cross-sectional shapes such as, from left to right, hexagonal-shaped with bore 36, square-shaped with bore 36, solid square-shaped, circular-shaped with bore 36, sold circular-shaped, and triangular-shaped with bore 36.

It is to be understood that the invention is not limited to the exact details of construction, operation, exact materials, or embodiments shown and described, as modifications and equivalents will be apparent to one skilled in the art. For example, the element material is not required to be a metal, carbide, or ceramic material and the body material is not required to be a composite or resin material. All that is required is that the element material be harder than the body material. Moreover, the shapes and dimensions of the hard material elements are not limited to those disclosed herein. Nor are the shapes and dimensions of the apertures through the inner and outer molds limited to those disclosed herein. In addition, there is no requirement that the inner mold be disposed concentrically with the outer mold. Instead, the inner mold could be disposed eccentrically so that one wedge can be cut from the tubular body that is thinner than another wedge. As a result, two slip members having different thicknesses can be manufactured from a single tubular body. Further, both ends of the hard material element are not required to extend outwardly from the body during manufacture. Instead, one end of the hard material element can be flush with the first or second surface of the tubular body so that one end is not required to be ground away during shaping of the slip member. Additionally, in embodiments in which the hard material elements include a bore, the ends of the bore can be masked or sealed to provide a chamber within the hard material elements. Moreover, the outer wall surfaces of the hard material elements can be roughened or polished to facilitate bonding the body material to the hard material element. Further, the first and second outer wall surfaces can be tapered from the second end toward the first end instead of vice versa. Accordingly, the invention is therefore to be limited only by the scope of the appended claims.

What is claimed is:

1. A slip member comprising:

a body, the body comprising an inner surface and an outer surface, the body comprising a first material; and a hard material element disposed through the body that extends from the inner surface to the outer surface, the hard material element comprising a second material, the second material being harder than the first material, wherein the hard material element extends outwardly from the outer surface and wherein the first material captures the hard material element.

2. The slip member of claim 1, wherein the hard material element extends outwardly from the inner surface.

3. The slip member of claim 1, wherein the hard material element comprises a polygonal-shaped cross-section.

4. The slip member of claim 1, wherein the hard material element comprises a bore disposed through the hard material element.

5. The slip member of claim 4, wherein the hard material element comprises a polygonal-shaped cross-section.

6. The slip member of claim 4, wherein the bore is along a longitudinal axis of the hard material element.

7. The slip member of claim 1, wherein the hard material element is disposed through the body at an angle relative to a vertical axis of the slip member, the angle being in the range from 10 degrees to 60 degrees.

8. The slip member of claim 1, wherein the hard material element comprises a first end, a second end, a first wall surface connecting the first and second ends, and a second wall surface connecting the first and second ends, the first wall surface being tapered from the first end to the second end.

9. The slip member of claim 8, wherein the second wall surface is tapered from the first end to the second end.

10. The slip member of claim 9, wherein the first end comprises a gripping member.

11. The slip member of claim 1, wherein the hard material element comprises a first end, a second end, and a recess disposed around an outer wall surface, the recess being disposed between the first end and the second end.

12. The slip member of claim 11, wherein the recess is disposed approximately way between the first end and the second end.

13. The slip member of claim 1, wherein the hard material element comprises a first portion, a second portion, and a third portion, wherein the first portion is in communication with the outer surface, and the second and third portions each are in communication with the first portion and in communication with the inner surface.

14. The slip member of claim 1, wherein the hard material element comprises a first portion, a second portion, and a third portion, wherein the first portion is in communication with the inner surface, and the second and third portions each are in communication with the first portion and in communication with the outer surface.

15. A slip member comprising:

a body, the body comprising a first surface and a second surface, the body comprising a first material; and a hard material element disposed through the body in communication with the first surface and the second surface, the hard material element comprising a second material, the second material being harder than the first material;

wherein the hard material element comprises a first portion, a second portion, and a third portion, wherein the first portion is in communication with the first surface, and the second and third portions each are in communication with the first portion and in communication with the second surface.

16. A slip member comprising:

a body, the body comprising a first surface and a second surface, the body comprising a first material; and a hard material element disposed through the body in communication with the first surface and the second surface, the hard material element comprising a second material, the second material being harder than the first material;

wherein the hard material element comprises a first portion, a second portion, and a third portion, wherein the first portion is in communication with the second surface, and the second and third portions each are in communication with the first portion and in communication with the first surface.

* * * * *